US011421455B2

(12) United States Patent
Perkins et al.

(10) Patent No.: US 11,421,455 B2
(45) Date of Patent: Aug. 23, 2022

(54) HOOD LATCH FOR MOTOR VEHICLE HAVING UNDER HOOD STORAGE

(71) Applicant: Inteva Products, LLC, Troy, MI (US)

(72) Inventors: Donald Michael Perkins, Warren, MI (US); Ian J. Dow, Bloomfield, MI (US); Sameer Anand, Southfield, MI (US); Robert Durie, Troy, MI (US); Prashant Nayak, Bangalore (IN); Premanand Naik, Bangalore (IN)

(73) Assignee: INTEVA PRODUCTS, LLC, Troy, MI (US)

( * ) Notice: Subject to any disclaimer, the term of this patent is extended or adjusted under 35 U.S.C. 154(b) by 790 days.

(21) Appl. No.: 16/250,361

(22) Filed: Jan. 17, 2019

(65) Prior Publication Data

US 2020/0109580 A1 Apr. 9, 2020

(30) Foreign Application Priority Data

Oct. 3, 2018 (IN) ..... 201811037267

(51) Int. Cl.

| | |
|---|---|
| ***E05B 83/24*** | (2014.01) |
| ***E05B 81/64*** | (2014.01) |
| ***E05B 81/06*** | (2014.01) |
| ***E05B 81/14*** | (2014.01) |
| *E05B 77/00* | (2014.01) |

(52) U.S. Cl.

CPC ..... *E05B 83/24* (2013.01); *E05B 81/06* (2013.01); *E05B 81/14* (2013.01); *E05B 81/64* (2013.01); *E05B 77/00* (2013.01); *Y10T 292/1082* (2015.04)

(58) Field of Classification Search

CPC ..... E05B 83/24; E05B 81/06; E05B 81/14; E05B 81/64; E05B 77/00; Y10T 292/1082

See application file for complete search history.

(56) References Cited

U.S. PATENT DOCUMENTS

| | | | | | |
|---|---|---|---|---|---|
| 3,905,627 | A * | 9/1975 | Fujita | E05B 77/265 | 292/216 |
| 4,978,153 | A * | 12/1990 | Hirsch | B04B 7/06 | 292/201 |
| 5,288,115 | A * | 2/1994 | Inoue | E05B 81/20 | 292/201 |
| 5,516,164 | A * | 5/1996 | Kobayashi | E05B 81/20 | 292/201 |

(Continued)

FOREIGN PATENT DOCUMENTS

| | | | |
|---|---|---|---|
| CN | 1987028 | A | 6/2007 |
| CN | 104695779 | A | 6/2015 |

(Continued)

*Primary Examiner* — Carlos Lugo

(74) *Attorney, Agent, or Firm* — Cantor Colburn LLP

(57) ABSTRACT

A latch mechanism for a motor vehicle includes a latch body, a claw rotatably mounted in the latch body and operable to selectively retain a hood latch element, and a motor operatively connected to the claw. The motor is operably to rotate the claw to selectively release the hood latch element. A latch controller is operatively connected to the motor, and a speed sensor operatively connected to the latch controller. The speed sensor detects a speed of the motor vehicle. The latch controller operates the motor to rotate the claw based on the speed of the motor vehicle.

10 Claims, 7 Drawing Sheets

(56) References Cited

U.S. PATENT DOCUMENTS

| | | | | | |
|---|---|---|---|---|---|
| 5,938,252 | A * | 8/1999 | Uemura | E05B 81/64 | 292/201 |
| 6,335,687 | B1 * | 1/2002 | Terashima | A62B 33/00 | 340/425.5 |
| 8,480,138 | B2 * | 7/2013 | Bendel | E05B 85/26 | 292/201 |
| 8,764,075 | B2 * | 7/2014 | Taurasi | E05B 81/14 | 292/216 |
| 8,827,329 | B2 * | 9/2014 | Scholz | E05B 85/26 | 292/216 |
| 9,938,762 | B2 | 4/2018 | Goto | | |
| 10,837,205 | B2 | 11/2020 | Ishiguro | | |
| 2012/0175896 | A1 * | 7/2012 | Martinez | E05B 81/06 | 292/199 |
| 2014/0088826 | A1 | 3/2014 | Wheeler et al. | | |
| 2014/0203573 | A1 | 7/2014 | Lujan et al. | | |
| 2014/0252783 | A1 | 9/2014 | Yokota | | |

FOREIGN PATENT DOCUMENTS

| | | | | | |
|---|---|---|---|---|---|
| CN | 105096411 | A | 11/2015 | | |
| CN | 105735781 | A * | 7/2016 | | |
| DE | 102014118635 | A1 * | 4/2016 | E05B 81/30 | |
| DE | 102015118861 | A1 * | 5/2017 | E05B 81/20 | |
| GB | 2422632 | A | 8/2006 | | |
| KR | 100656758 | B1 | 12/2006 | | |

* cited by examiner

HOOD LATCH FOR MOTOR VEHICLE HAVING UNDER HOOD STORAGE

BACKGROUND OF THE INVENTION

The subject matter disclosed herein relates to the art of motor vehicles and, more particularly, to a hood latch for a motor vehicle having under hood storage.

Traditionally, most vehicles produced in the United States including a trunk or rear compartment that was used for storage. The trunk was provided with a trunk lid having a latch that could be operated with a key inserted into a lock, through manipulation of a button on a vehicle remote, or through manipulation of a control member in an occupant compartment. In addition to external systems for opening the trunk, a mechanism was installed internally to the trunk.

The mechanism in the trunk was provided to enable a person, which may be trapped in the trunk, a way to open the trunk lid in compliance with local motor vehicle standards. Currently, certain motor vehicles are being designed with a forward storage zone. That is, a vehicle hood may be opened to expose a storage zone similar to a trunk. With the advent of forward storage zones, the hood must include a system that would enable a person trapped inside a way to egress.

BRIEF DESCRIPTION OF THE INVENTION

Disclosed is a latch mechanism for a motor vehicle including a latch body, a claw rotatably mounted in the latch body and operable to selectively retain a hood latch element, and a motor operatively connected to the claw. The motor is operably to rotate the claw to selectively release the hood latch element. A latch controller is operatively connected to the motor, and a speed sensor operatively connected to the latch controller. The speed sensor detects a speed of the motor vehicle. The latch controller operates the motor to rotate the claw based on the speed of the motor vehicle.

Also disclosed is a method of operating a hood latch for a vehicle including sensing a speed of the vehicle, receiving a latch actuation command, and moving a claw to release a hood latch element based on the speed of the vehicle.

Further disclosed is a motor vehicle including a body having a passenger compartment, and a forward storage zone including a hood latch element. A hood is pivotally mounted to the body to selectively cover the forward storage zone. The hood includes a latch mechanism including a latch body mounted to the hood, a claw rotatably mounted in the latch body and operable to selectively retain the hood latch element, and a motor operatively connected to the claw. The motor is operable to rotate the claw to selectively release the hood latch element. A latch controller is operatively connected to the motor, and a speed sensor is operatively connected to the latch controller. The speed sensor detects a speed of the motor vehicle. The latch controller operates the motor to rotate the claw based on the speed of the motor vehicle.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
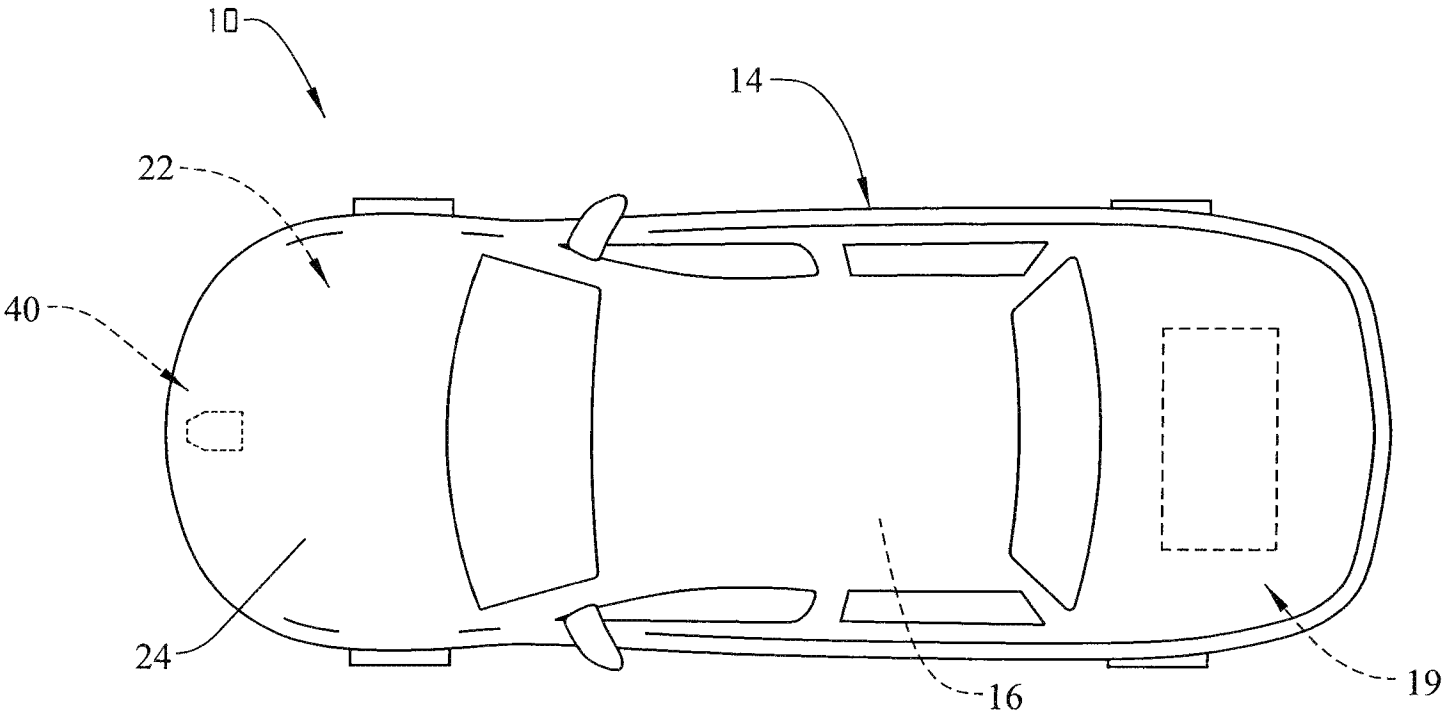
FIG. 1 depicts a top view of a motor vehicle having a hood latch mechanism, in accordance with an exemplary aspect.
Figure 2:
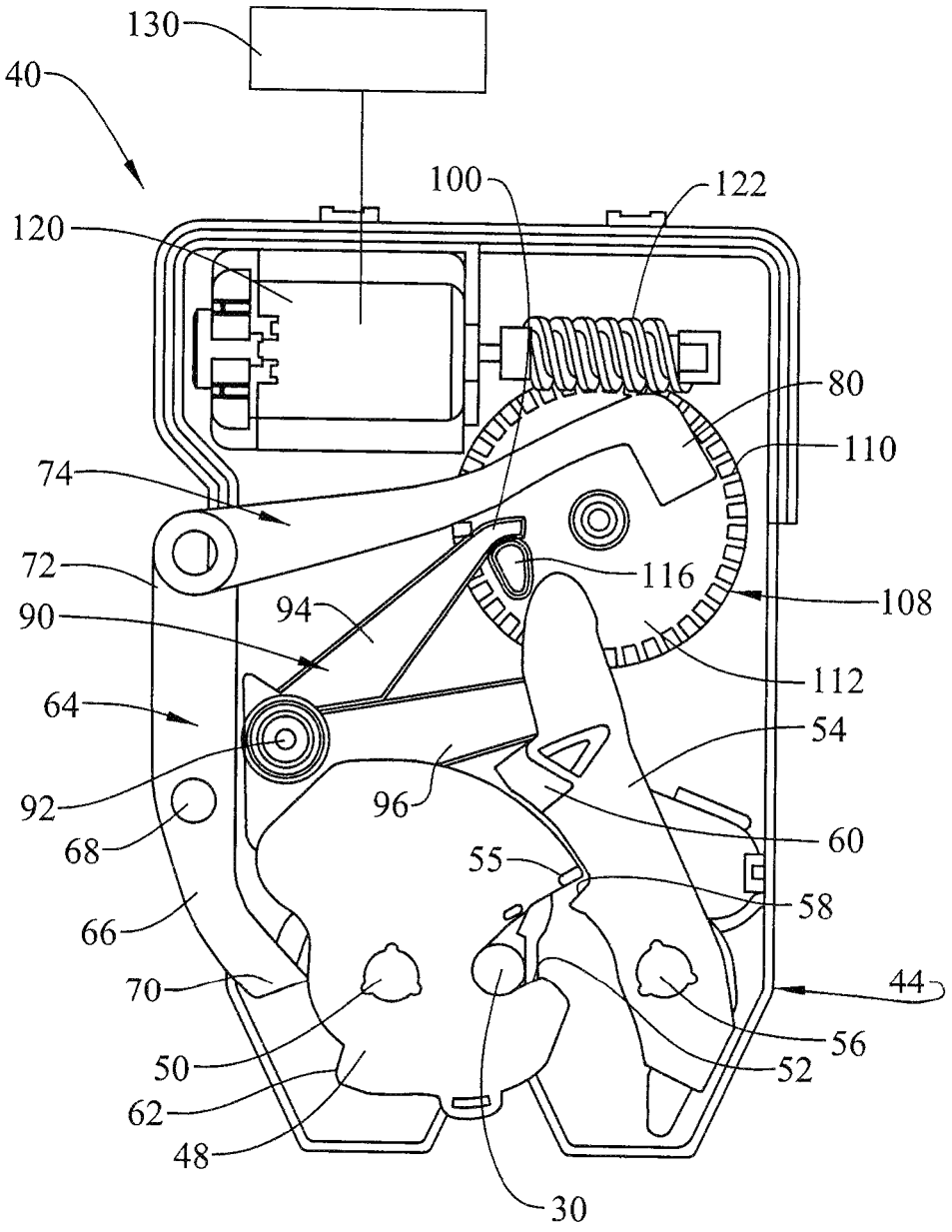
FIG. 2 depicts a plan view of the latch mechanism of FIG. 1, in a latched position, in accordance with an aspect of an exemplary embodiment.

With initial reference to FIG. 1, a motor vehicle is indicated generally at 10. Motor vehicle 10 includes a body 14 that defines an occupant compartment 16. Body 14 supports a prime mover 19 which may take on a variety of forms including internal combustion engines, hybrid engines, and electric motors. Prime mover 19 may be mounted in a rear portion (not separately labeled) of body 14 or may be arranged as a mid-engine configuration. In an embodiment, body 14 includes a forward storage compartment 22 having a hood 24. As will be detailed herein, hood 24 includes a hood latch element 30 (FIG. 2) that cooperates with a latch mechanism 40. Latch mechanism 40 engages hood latch element 30 to secure hood 24 in a closed position.

Figure 4:
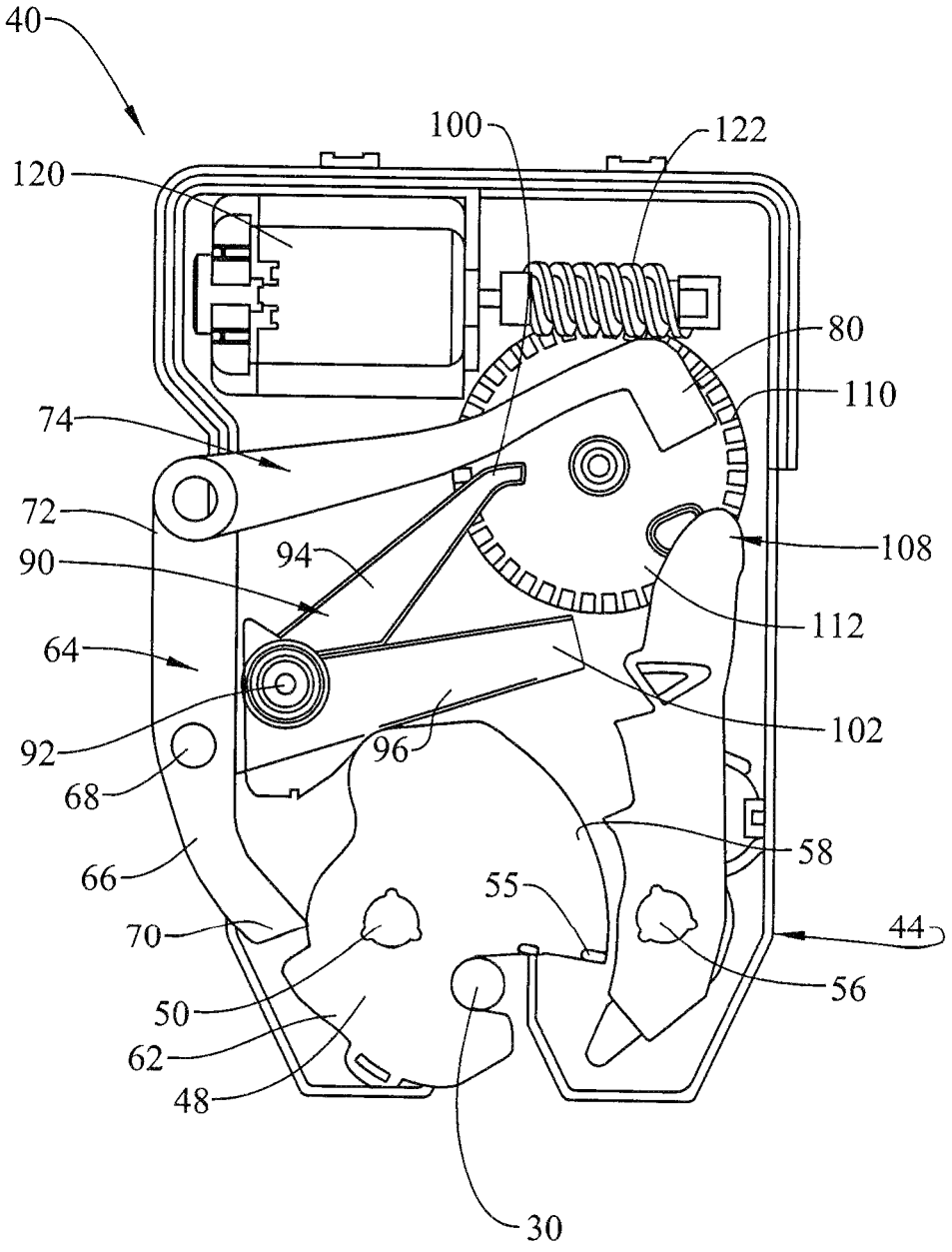
FIG. 4 a plan view of the latch mechanism of FIG. 1, in a partially unlatched position, in accordance with an aspect of an exemplary embodiment

In an embodiment, latch mechanism 40 includes a latch body or housing 44 that supports a claw 48. Claw 48 is rotatable about a pin 50 and includes a latch element receiving portion 52. Claw 48 may be connected to a spring (not shown) that imparts a selected rotational bias. A first pawl 54 rotatably mounted in latch body 44 through a pin 56. First pawl 54 includes a claw engagement section 58 that may cooperate with a lobe 55 on claw 48. When claw engagement section 58 engages lobe 55 claw 48 is prevented from rotating. First pawl 54 also includes a hold open section 60 that selectively engages with a stop lobe 62 on claw 48. As will be detailed herein, when hold open section 60 engages with stop lobe 62 claw 48 has rotated to a first or partially open position (FIG. 4).

Figure 5:
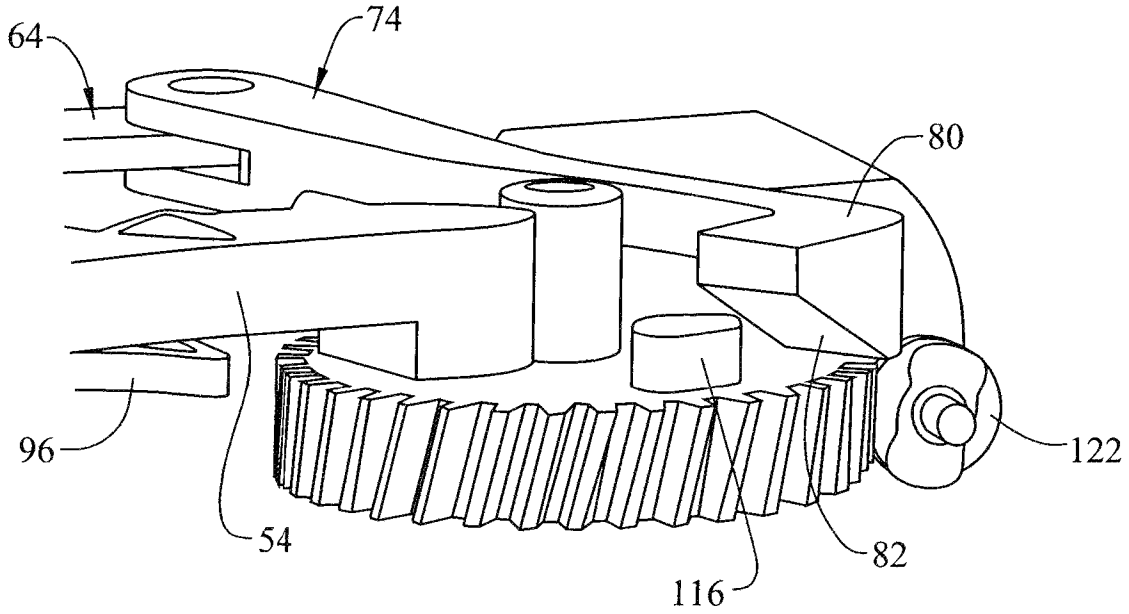
FIG. 5 is a partial perspective view of an actuator gear of the latch mechanism, in accordance with an aspect of an exemplary embodiment.

Latch mechanism 40 also includes a second pawl 64 that is rotatably mounted in latch body 44 about a pin 68. Second pawl 64 includes a first end portion 70 that may selectively engage with stop section 62 of claw 48 and a second end portion 72 that pivotally supports a coupling lever 74. Coupling lever 74 includes an end section 80 having a ramped surface 82 (FIG. 5). Latch mechanism 40 is further shown to include a hold open lever 90 rotatably supported in latch housing 44 through a pin 92. Hold open lever 90 includes a first hold open lever member 94 and a second hold open lever member 96 that rotate about pin 92. First hold open lever member 94 includes an end portion 100 and second hold open lever member 96 includes an end portion 102 (FIG. 4).

Latch mechanism 40 also includes an actuator gear 108 mounted in latch housing 44. Actuator gear 108 includes an outer circumferential edge (not separately labeled) that supports a plurality of gear teeth, one of which is indicated at 110. Actuator gear 108 also includes an outer planar surface 112 that supports a cam member 116. A motor 120 is mounted in latch housing 44 and connected to actuator gear 108 by a worm gear 122. Motor 120 is connected to a controller 130 which, as will be detailed herein, selectively operates latch mechanism 40.

Figure 3:
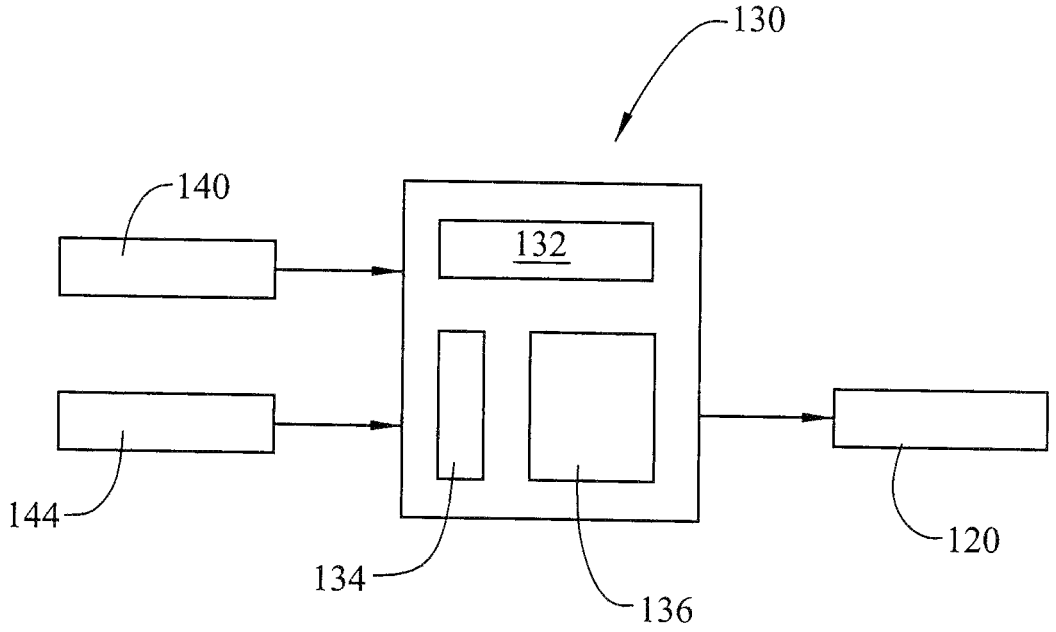
FIG. 3 depicts a block diagram illustrating a controller for the latch mechanism, in accordance with an aspect of an exemplary embodiment.

As shown in FIG. 3, controller 130 includes a processor 132 and a non-volatile memory 134. Processor 132 may take on various forms including central processor units (CPU) and graphics processor units (GPU). Non-volatile memory 134 includes a set of instructions of operating latch mechanism 40. Controller 130 also includes an actuator module 136 that delivers a control signal to motor 120 based on instructions received from, for example, processor 132 via no-volatile memory 134. At this point, it should be understood that while shown as being co-located at controller 130, processor 132, non-volatile memory 134 and actuator module 136 may be arranged in various parts of vehicle 10.

Figure 7:
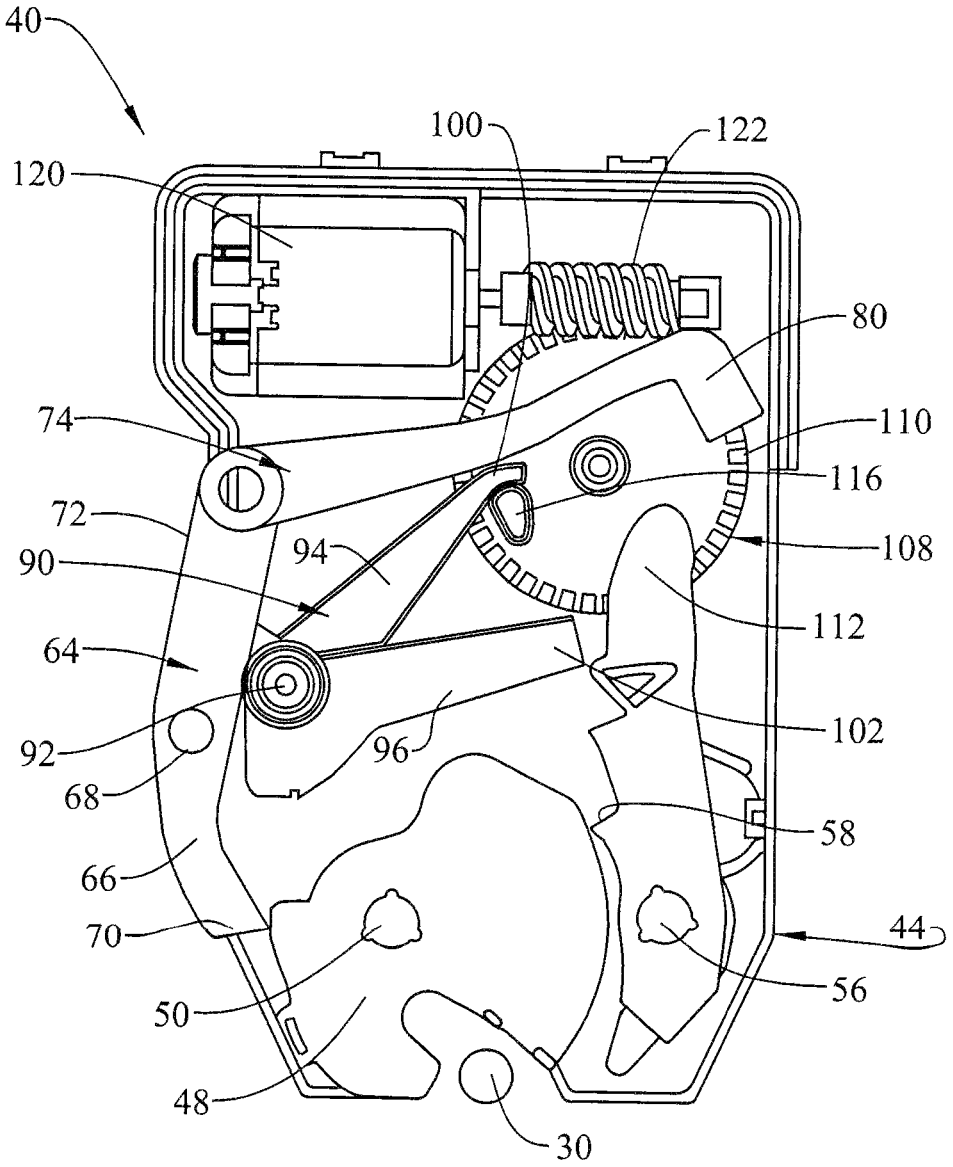
FIG. 7 depicts the latch mechanism in an unlatched position, in accordance with an aspect of an exemplary embodiment.

In an embodiment, signals may be passed to motor 120 from controller 130 based on inputs from a speed sensor 140 and an actuator member 144. In an embodiment, actuator member 144 is arranged in forward storage zone 22 and may be selectively actuated by an occupant trapped therein. It should be understood that there may be other actuator members (not separately labeled) arranged in vehicle 10 and/or associated with a vehicle key (not shown). As will be detailed herein, activation of latch mechanism 40 from a closed position (FIG. 2) to a fully open or hood release position (FIG. 7) is dependent upon vehicle speed. That is above a select speed threshold, for example 5 km/hr, latch mechanism 40 will not fully release hood 24.

In an embodiment, if vehicle speed is substantially zero, an input received from actuator member 144 will cause motor 120 to rotate actuation gear 108 in a first direction, such as counter-clockwise (CCW) to release first pawl 54 and then in a second direction, such as clockwise (CW) to release second pawl 64 allowing claw 48 to rotate and release hood latch element 30. That is, a single actuation of actuator member 144 will release hood latch element 30 when vehicle 10 is stopped.

Figure 6:
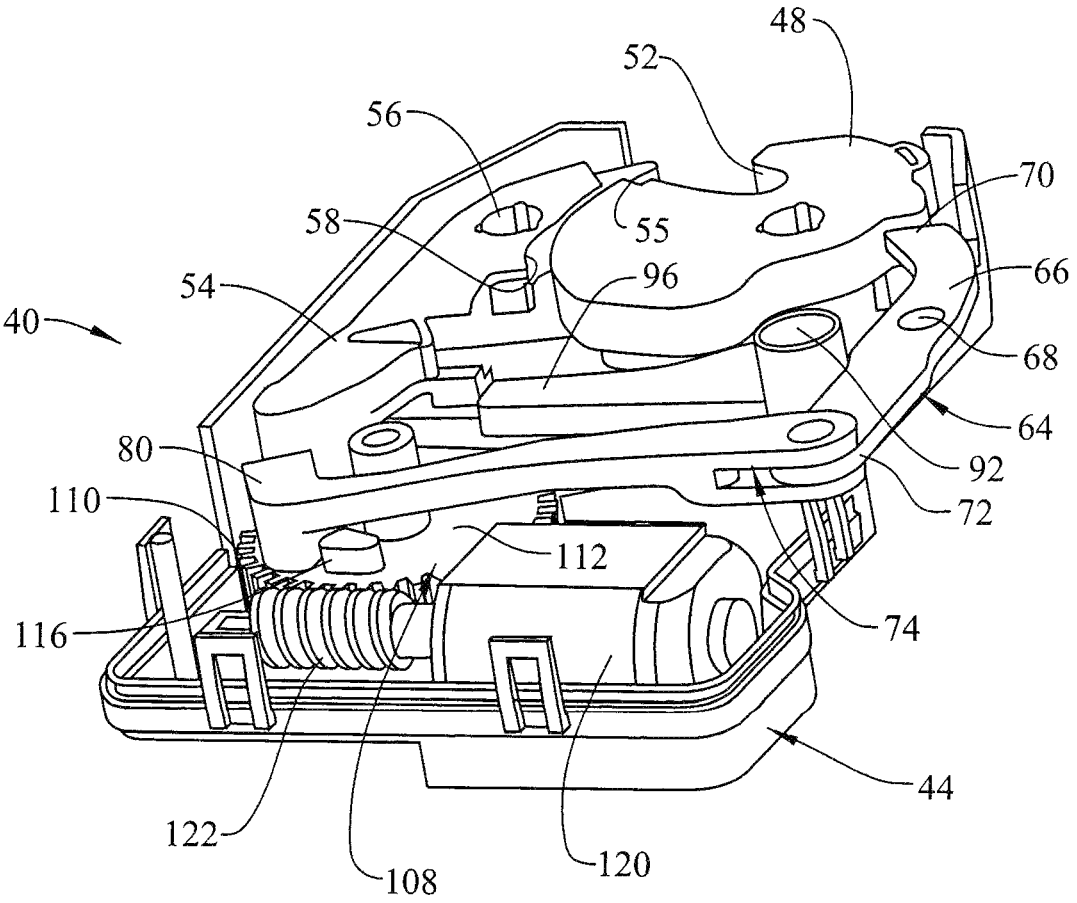
FIG. 6 depicts a perspective view of the latch mechanism of FIG. 4, in accordance with an aspect of an exemplary embodiment.

If vehicle 10 is moving, a first actuation of actuator member 144 will cause motor 120 to rotate actuator gear 108 in the CCW direction releasing first pawl 54 allowing claw 48 to partially rotate. That is, claw 48 may rotate until stop section 62 engages end portion 70 of second pawl 64. In this position, hood 24 is partially released such as shown in FIG. 4. At the same time, hold open lever 90 drops into contact with first pawl 54. Further CCW rotation of actuation gear 108 causes cam member 116 to engage ramped surface 82 of coupling lever 74 as shown in FIG. 5. Coupling lever raises up allowing cam member 116 to pass such as shown in FIG. 6.

If vehicle speed is greater than the selected speed threshold, a second actuation of actuator member 144 does not release hood 24. Latch mechanism 40 will remain in the partially un-latched or open position such as shown in FIG. 4. If vehicle speed is greater than zero and less than the selected speed threshold, a second activation of actuator member 144 will cause motor 120 to rotate actuator gear 108 in the CW direction releasing hold open lever 90 and translating coupling lever 74 causing second pawl 64 to release claw 48. At this point, claw 48 may rotate to the fully open position (FIG. 7) releasing hood latch element 13 allowing hood 24 to open.

The terms "about" and "substantially" are intended to include the degree of error associated with measurement of the particular quantity based upon the equipment available at the time of filing the application. For example, "about" and "substantially" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A hood latch mechanism for a motor vehicle comprising:

a latch body;

a claw rotatably mounted in the latch body and operable to selectively retain a hood latch element;

a motor;

a release gear operatively connected to the motor;

a first pawl pivotally mounted in the latch body and selectively operatively connected to the release gear, the first pawl selectively retaining the claw in a latched configuration;

a second pawl pivotally mounted in the latch body and selectively retaining the claw in a partially unlatched configuration;

a latch controller operatively connected to the motor; and a speed sensor operatively connected to the latch controller, the speed sensor detecting a speed of the motor vehicle;

an actuator member operatively connected to the latch controller, wherein if vehicle speed is below a selected speed threshold, a first actuation of the actuator member causes the motor to rotate the release gear in a first direction to release the first pawl and in a second direction, opposite the first direction, to release the second pawl allowing the claw to rotate and release the hood latch element, and wherein if the vehicle speed is greater than the selected speed threshold a second actuation of the actuator member causes the motor to rotate the release gear in the first direction to release the first pawl allowing the claw to move to the partially unlatched position and remain in that position preventing a release of the hood latch element.

2. The hood latch mechanism according to claim 1, further comprising:

a coupling lever selectively operatively connecting the second pawl and the release gear, the second pawl selectively retaining the claw in a partially unlatched position.

3. The hood latch mechanism according to claim 2, further comprising: a hold open lever pivotally mounted in the latch body, the hold open lever selectively engaging the first pawl to shift the claw to an unlatched position.

4. A method of operating a vehicle hood latch including a latch body, a claw rotatably mounted in the latch body and operable to selectively retain a hood latch element, a motor, a release gear operatively connected to the motor, a first pawl pivotally mounted in the latch body and selectively operatively connected to the release gear, the first pawl selectively retaining the claw in a latched configuration, a second pawl pivotally mounted in the latch body and selectively retaining the claw in a partially unlatched configuration a latch controller operatively connected to the motor, a speed sensor for detecting vehicle speed operatively connected to the latch controller, and an actuator member operatively connected to the latch controller, the method comprising:

sensing a speed of the vehicle;

passing the speed of the vehicle to the latch controller;

rotating the release gear in a first direction upon receipt of a first latch actuation command to release the first pawl and in a second direction, opposite the first direction, to release the second pawl allowing the claw to rotate and release the hood latch element when the vehicle speed is lower than a selected speed threshold; and rotating the release gear in the first direction upon receipt of a second latch actuation command to release the first pawl allowing the claw to move to the partially unlatched position and remain in that position preventing a release of the hood latch element when the vehicle speed is greater than the selected speed threshold.

5. The method of claim 4, further comprising: preventing the claw from moving to a fully unlatched position if the speed of the vehicle is greater than the selected speed threshold.

6. The method of claim 4, wherein rotating the claw to the partially unlatched position includes receiving the second latch actuation command and sensing the speed of the vehicle is greater than 5 km/hr.

7. The method of claim 4, wherein rotating the claw upon receipt of the first latch actuation command includes releasing the hood latch element if the speed of the vehicle is substantially zero.

8. A motor vehicle comprising:

a body including a passenger compartment and a forward storage zone including a hood latch element; and a hood pivotally mounted to the body to selectively cover the forward storage zone, the hood including a hood latch mechanism comprising:

a latch body mounted to the hood;

a claw rotatably mounted in the latch body and operable to selectively retain the hood latch element;

a motor;

a release gear operatively connected to the motor;

a first pawl pivotally mounted in the latch body and selectively operatively connected to the release gear, the first pawl selectively retaining the claw in a latched configuration;

a second pawl pivotally mounted in the latch body and selectively retaining the claw in a partially unlatched configuration;

a latch controller operatively connected to the motor; and a speed sensor operatively connected to the latch controller, the speed sensor detecting a speed of the motor vehicle;

an actuator member operatively connected to the latch controller, wherein if vehicle speed is below a selected speed threshold, a first actuation of the actuator member causes the motor to rotate the release gear in a first direction to release the first pawl and in a second direction, opposite the first direction, to release the second pawl allowing the claw to rotate and release the hood latch element, and wherein if the vehicle speed is greater than the selected speed threshold a second actuation of the actuator member causes the motor to rotate release gear in the first direction to release the first pawl allowing the claw to move to the partially unlatched position and remain in that position preventing a release of the hood latch element.

9. The latch mechanism according to claim 8, further comprising:

a coupling lever selectively operatively connecting the second pawl and the release gear, the second pawl selectively retaining the claw in a partially unlatched position.

10. The latch mechanism according to claim 9, further comprising: a hold open lever pivotally mounted in the latch body, the hold open lever selectively engaging the first pawl to shift the claw to an unlatched position.

* * * * *